US009389535B2

(12) United States Patent
Hotani

(10) Patent No.: US 9,389,535 B2
(45) Date of Patent: Jul. 12, 2016

(54) IMAGE FORMING APPARATUS WITH DEVELOPING DEVICE HAVING RIBS

(71) Applicant: KYOCERA Document Solutions Inc., Osaka (JP)

(72) Inventor: Tomoya Hotani, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/839,347

(22) Filed: Aug. 28, 2015

(65) Prior Publication Data

US 2016/0070197 A1 Mar. 10, 2016

(30) Foreign Application Priority Data

Sep. 9, 2014 (JP) ..... 2014-183044

(51) Int. Cl.
*G03G 21/18* (2006.01)
*G03G 15/08* (2006.01)

(52) U.S. Cl.
CPC ..... *G03G 15/0812* (2013.01); *G03G 21/1821* (2013.01); *G03G 21/1839* (2013.01); *G03G 21/1853* (2013.01); *G03G 2221/1853* (2013.01)

(58) Field of Classification Search
CPC ..... G03G 21/1835; G03G 2221/1884; G03G 21/1896
See application file for complete search history.

(56) References Cited

U.S. PATENT DOCUMENTS

| | | | | |
|---|---|---|---|---|
| 6,549,737 | B2 * | 4/2003 | Sano | G03G 21/1821 399/111 |
| 7,218,882 | B2 * | 5/2007 | Toba | G03G 15/0812 399/284 |
| 7,565,093 | B2 * | 7/2009 | Okabe | G03G 21/1821 399/111 |
| 7,639,966 | B2 * | 12/2009 | Sato | G03G 21/1638 399/107 |
| 2014/0205321 | A1 * | 7/2014 | Jang | G03G 21/1853 399/119 |

FOREIGN PATENT DOCUMENTS

JP H09-190080 A 7/1997

* cited by examiner

*Primary Examiner* — Clayton E Laballe
*Assistant Examiner* — Leon W Rhodes, Jr.
(74) *Attorney, Agent, or Firm* — Studebaker & Brackett PC

(57) ABSTRACT

An image forming apparatus includes: a drum unit having a photosensitive drum: a developing device having a developing roller that supplies toner to the image bearing member and a developer container that rotatably supports the developing roller; and a main apparatus body to which the drum unit and the developing device are detachably attached. The drum unit and the developing device are integrally attachable to and integrally detachable from the main apparatus body. The developer container includes a pair of ribs on an upper surface thereof at positions corresponding to opposite axial ends of the developing roller. The ribs abut against a casing part of the main apparatus body while the drum unit and the developing device are being integrally attached to and integrally detached from the main apparatus body.

4 Claims, 9 Drawing Sheets

IMAGE FORMING APPARATUS WITH DEVELOPING DEVICE HAVING RIBS

INCORPORATION BY REFERENCE

The present application claims priority under 35 U.S.C. §119 to Japanese Patent Application No. 2014-183044, filed on Sep. 9, 2014. The contents of this application are incorporated herein by reference in their entirety.

BACKGROUND

The present disclosure relates to image forming apparatuses. In particular, the present disclosure relates to an image forming apparatus including an image bearing unit and a developing device that are integrally attachable to and integrally detachable from a main apparatus body.

Typically known image forming apparatuses include an image bearing unit and a developing device that are integrally attachable to and integrally detachable from the main apparatus body.

In one known example of such image forming apparatuses, a drum unit (image bearing unit) including a photosensitive drum (image bearing member) and a developing device including a developing roller are separately provided. The drum unit and the developing device of the image forming apparatus are coupled to each other with a coupling member. The drum unit, the developing device, and the coupling member coupled together are attachable to and detachable from the main apparatus body of the apparatus.

As described above, the image forming apparatus allows the drum unit and the developing device to be collectively attached to and collectively detached from the main apparatus body. This configuration can therefore improve the ease in attachment and detachment of the drum unit and the developing device to and from the main apparatus body.

SUMMARY

An image forming apparatus according to the present disclosure includes an image bearing unit, a developing device, and a main apparatus body. The image bearing unit includes an image bearing member on which an electrostatic latent image is formed. The developing device includes a developing roller and a first housing. The developing roller is disposed opposite to the image bearing member and supplies toner to the image bearing member. The first housing stores therein developer containing the toner and rotatably supports the developing roller. To the main apparatus body, the image bearing unit and the developing device are detachably attached. The image bearing unit and the developing device are integrally attachable to and integrally detachable from the main apparatus body. The first housing includes a pair of ribs on an upper surface thereof at positions corresponding to opposite axial ends of the developing roller. The ribs abut against a casing part of the main apparatus body while the image bearing unit and the developing device are being integrally attached to and integrally detached from the main apparatus body.

DETAILED DESCRIPTION

Figure 1:
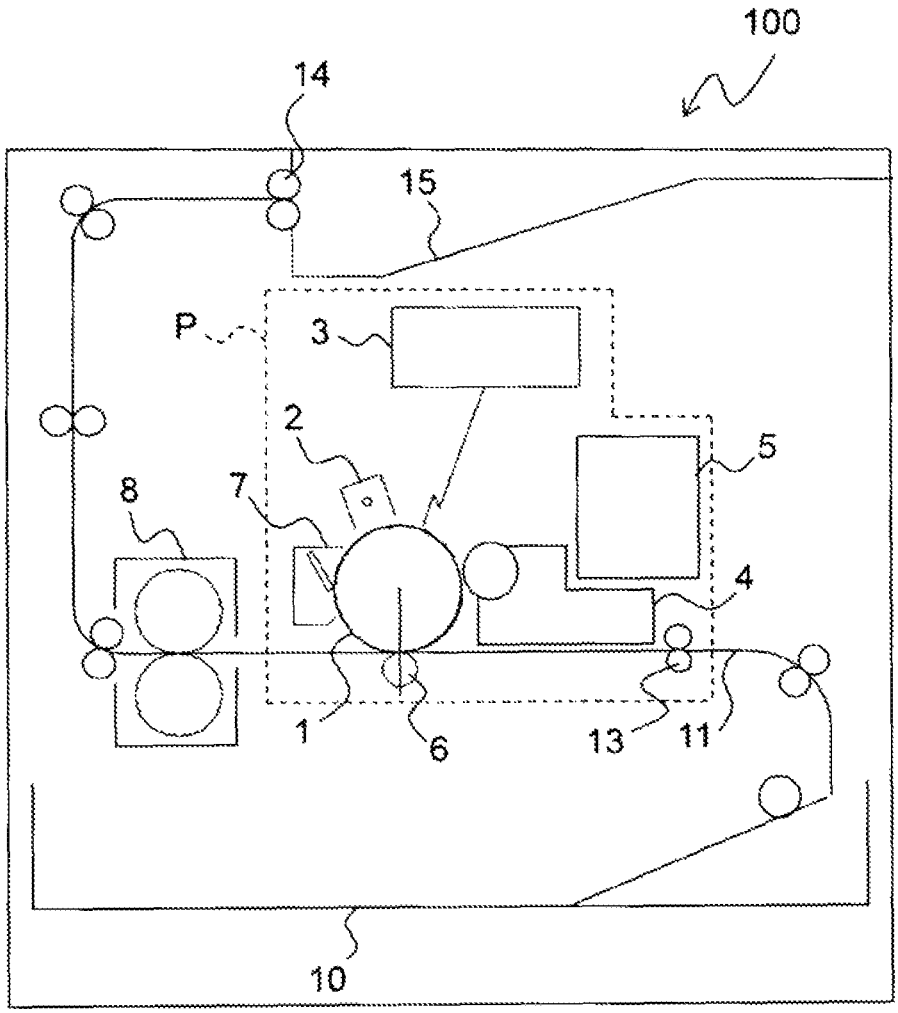
FIG. 1 is a cross sectional view of an overall structure of an image forming apparatus according to an embodiment of the present disclosure.

An embodiment of the present disclosure is described below with reference to the accompanying drawings.

With reference to FIGS. 1 to 10, the structure of an image forming apparatus 100 according to the embodiment of the present disclosure is described. The image forming apparatus 100 includes an image forming section P within the main apparatus body and performs an image forming operation in which the image forming section P forms an electrostatic latent image based on image data of an original document. The image data of the original document is transmitted from a non-illustrated personal computer (PC). A developing device 4 causes toner to adhere to the electrostatic latent image to form a toner image. A toner container 5 serving as a developer supply unit supplies toner to the developing device 4. The image forming apparatus 100 having the above structure performs an image forming process on a photosensitive drum 1 (image bearing member) while rotating the photosensitive drum 1 clockwise. The image forming apparatus 100 is for example a monochrome printer.

The image forming section P includes a charger 2, a laser scanning unit (LSU) 3, the developing device 4, a transfer roller 6, a cleaning device 7, and a static eliminating device (not shown) arranged along a rotation direction of the photosensitive drum 1. The rotation direction of the photosensitive drum 1 is clockwise in FIG. 1. The photosensitive drum 1 is for example an aluminum drum coated with a photosensitive layer. The charger 2 charges the surface of the photosensitive drum 1. The LSU 3, which will be described later, scans a laser beam across the surface of the photosensitive drum 1 to form an electrostatic latent image having attenuated static electricity. The photosensitive layer mentioned above is not specifically limited to a specific type. Preferable examples of the photosensitive layer include a layer of amorphous silicon (a-Si) having an excellent durability and a layer of organic photoconductor (OPC) that generates a limited amount of ozone while in the charged state. Use of the photosensitive drum 1 having an OPC layer enables the image forming section P to form a high resolution image.

The charger 2 uniformly charges the surface of the photosensitive drum 1. The charger 2 may for example a corona discharge device. A corona discharge device includes a thin wire or the like serving as an electrode and generates a discharge in response to high voltage applied to the electrode. Instead of a corona discharge device, the charger 2 may be a contact-type charging device. A contact-type charging device applies voltage to a charging member, typified by a charging roller, while the charging member is in contact with the surface of the photosensitive member. The LSU 3 scans a light beam across the surface of the photosensitive drum 1 based on image data so as to form an electrostatic latent image on the surface of photosensitive drum 1. The light beam is for example a laser beam (a ray of light).

The developing device 4 causes toner to adhere to the electrostatic latent image formed on the surface of the photosensitive drum 1 so as to form a toner image. The developing device 4 contains a magnetic one-component developer. The magnetic one-component developer consists of a magnetic toner component alone. In the following description of the present specification, the magnetic one-component developer may also be referred to simply as toner. The detailed structure of the developing device 4 is described later. The transfer roller 6 transfers the toner image from the surface of the photosensitive drum 1 to a sheet of paper conveyed through a paper conveyance path 11, without causing any unintentional change to the toner image. The cleaning device 7 includes a cleaning roller and a cleaning blade each of which makes a line contact longitudinally with the photosensitive drum 1. The cleaning device 7 removes residual toner from the surface of the photosensitive drum 1 after toner image transfer to paper.

The LSU 3 scans a laser beam across the surface of the photosensitive drum 1 based on image data received in advance. As a result, an electrostatic latent image conforming to the image data is formed on the surface of the photosensitive drum 1. Then, the developing device 4 causes toner to adhere to the electrostatic latent image to form a toner image.

To the image forming section P that forms a toner image in a manner described above, paper is fed from a paper container section 10. A sheet of paper is conveyed to pass through the paper conveyance path 11 and a pair of registration rollers 13 and reaches a position between the transfer roller 6 and the photosensitive drum 1 with a predetermined timing. In the image forming section P, the transfer roller 6 transfers the toner image formed on the surface of the photosensitive drum 1 to the sheet of paper. The sheet of paper having the toner image transferred thereto is separated from the photosensitive drum 1 and conveyed to the fixing section 8. The fixing section 8 applies heat and pressure to the sheet of paper to fix the toner image on the paper. The sheet of paper having passed the fixing section 8 then passes between a pair of discharging rollers 14 and is ejected to a paper ejecting section 15.

Next, the following describes an imaging unit 70 that includes a drum unit 30 and the developing device 4. The drum unit 30 in turn includes the photosensitive drum 1 and serves an image bearing unit that. In the imaging unit 70 shown in FIG. 2, the drum unit 30, the developing device 4, and the toner container 5 (see FIG. 1) are retained by a retaining frame 60. Note that FIGS. 2 and 5 to 10 show the imaging unit 70 without the toner container 5.

The retaining frame 60 has a bottom portion 61 and lateral portions 62. The lateral portions 62 upstand from the respective widthwise edges of the bottom portion 61.

The drum unit 30 is attached to a rear edge portion of the retaining frame 60. In other words, the drum unit 30 is attached to a downstream side of the retaining frame 60 in terms of a paper conveyance direction (left side in FIG. 2). The drum unit 30 is provided with a housing 31 serving as a second housing that houses the photosensitive drum 1, the charger 2, and the cleaning device 7.

The developing device 4 is attached centrally to the retaining frame 60 with respect to the front and rear directions. In other words, the developing device 4 is attached to the retaining frame 60 at a lateral center of FIG. 2 and at the front of the drum unit 30. As shown in FIG. 3, the developing device 4 additionally includes a developing roller 20 serving as a developer bearing member, a regulating blade 21 made of a metal plate, a stirring and conveying member (not shown) for conveying developer while string, and a developer container 40 serving as a first housing that houses the components of the developing device 4.

The developer container 40 defines an outer shell of the developing device 4. The developer container 40 has a main body part 41 that is open at an upper surface and a cover part 42 that closes the upper surface of the main body part 41. The developer container 40 is loaded with a one-component developer consisting of a magnetic toner. The developer container 40 holds the stirring and conveying member (not shown) and the developing roller 20 in a manner to allow their rotations. The developer container 40 additionally has an opening slot 40*a* through which the developing roller 20 is exposed toward the photosensitive drum 1 (see FIG. 1).

The developing roller 20 is disposed opposite to the photosensitive drum 1 with a predetermined gap. The developing roller 20 supplies toner to the photosensitive drum 1 sequentially from a region rotated to face the photosensitive drum 1. The supplied toner develops the electrostatic latent image on the photosensitive drum 1.

Figure 4:
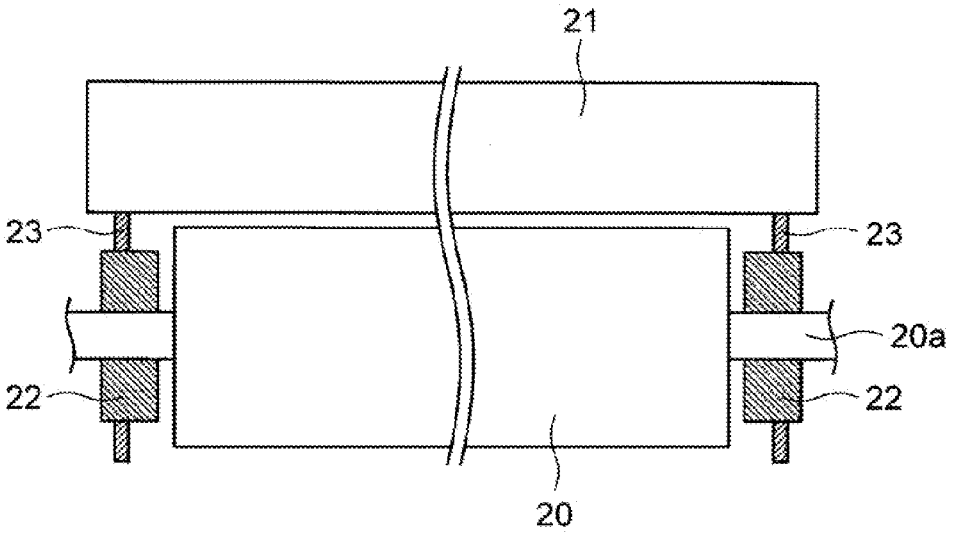
FIG. 4 is a cross sectional view of a developing roller showing the structure around opposite axial ends thereof, the developing roller being included in the developing device of in the image forming apparatus according to the embodiment of the present disclosure.

As shown in FIG. 4, in addition, the developing roller 20 has a rotation shaft 20*a* provided with a bearing 22 and a blade retainer 23 made of a metal plate at either end of the rotation shaft 20*a*. The bearings 22 axially support the rotation shaft 20*a*. The blade retainers 23 are each disposed on the outer circumferential surface of a corresponding one of the bearings 22 to retain the regulating blade 21. The blade retainers 23 keep a gap of a fixed size between the regulating blade 21 and the developing roller 20. The regulating blade 21 is located opposite to the developing roller 20 with the gap of the fixed size above the developing roller 20.

As shown in FIG. 3, the cover part 42 closes a space containing the regulating blade 21 and other components from above. The cover part 42 includes ribs 42*a* that are integrally formed on the upper surface of the cover part 42 at positions closer to the rear edge of the cover part 42 and corresponding to the axial ends of the developing roller 20. That is, the ribs 42*a* are integrally formed at the widthwise edge portions of the cover part 42. The ribs 42*a* are disposed above the edge portions of the regulating blade 21

Each rib 42*a* protrudes upward slightly from the upper surface of the cover part 42 and protrudes slightly beyond the rear edge of the upper surface (toward left in FIG. 2) of the cover part 42. Each rib 42*a* has an upper surface 42*b* and an inclined surface 42*c* that extends downward from the upper surface 42*b* at an acute angle relative to the upper surface 42*b*.

As will be described later with reference to FIG. 6, the upper surface 42*b* of each rib 42*a* abuts against a lower surface of an upper portion of a casing 101 of the main apparatus body during attachment and during detachment of the imaging unit 70. The lower surface of the upper portion of the casing 101 refers to a surface of the casing 101 that faces toward the upper surface 42*b* of each rib 42*a*. As described later with reference to FIG. 9, the inclined surface of each rib 42*a* abuts against a front edge portion of an upper surface 31*a* of the housing 31 of the drum unit 30 during detachment of the developing device 4 from the drum unit 30.

The toner container 5 is attached to the front edge portion of the retaining frame 60. In other words, the toner container 5 is attached at an upstream side of the retaining frame 60 in terms of the paper conveyance direction (left side in FIG. 2). The toner container 5 is attachable to and detachable from the retaining frame 60 with the developing device 4 remain attached to the retaining frame 60.

The drum unit 30, the developing device 4, the toner container 5, and the retaining frame 60 are in an assembled state as the imaging unit 70 so as to be integrally attached to and integrally detached from the main apparatus body of the image forming apparatus 100.

Next, a description is given of the attachment and detachment operation of the imaging unit 70 to and from the main apparatus body of the image forming apparatus 100. Note that the imaging unit 70 is an integral part formed of the drum unit 30, the developing device 4, the toner container 5, and the retaining frame 60.

Figure 5:
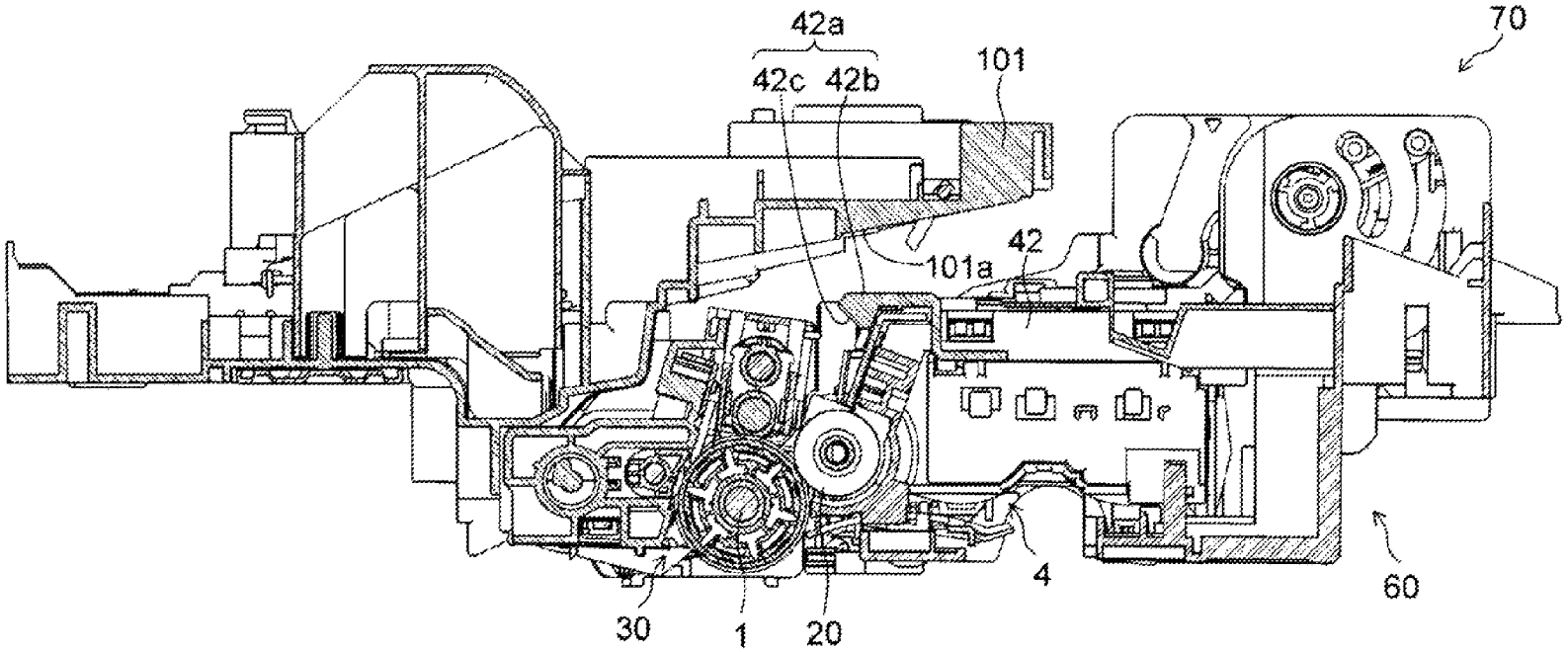
FIG. 5 is a sectional view of the image forming apparatus according to the embodiment of the present disclosure, with the imaging unit attached to the main apparatus body.
Figure 6:
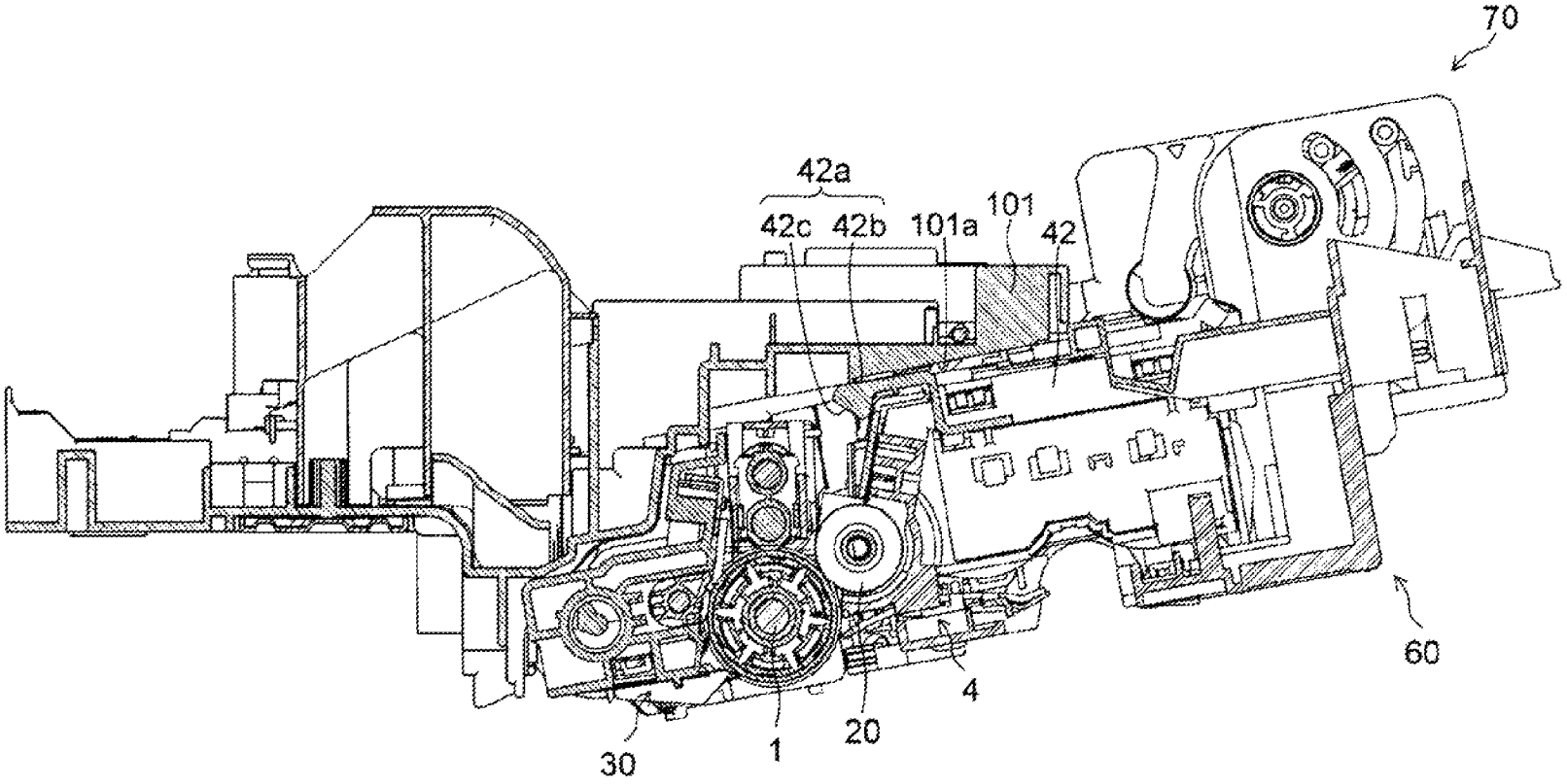
FIG. 6 is a sectional view of the image forming apparatus according to the embodiment of the present disclosure, with the imaging unit being pulled out the main apparatus body.

In a state shown in FIG. 5, to pull out the imaging unit 70 from the main apparatus body, the front edge portion of the imaging unit 70, that is the right edge portion of the imaging unit 70 shown in FIG. 5, is lifted up to be in a state shown in FIG. 6. In this state, the upper surface 42*b* of each rib 42*a* of the cover part 42 abuts against the lower surface of the upper portion of the casing 101 of the main apparatus body. The lower surface of the upper portion is denoted by a reference sign 101*a* and located below an upper rib of the casing 101 of the main apparatus body.

Figure 7:
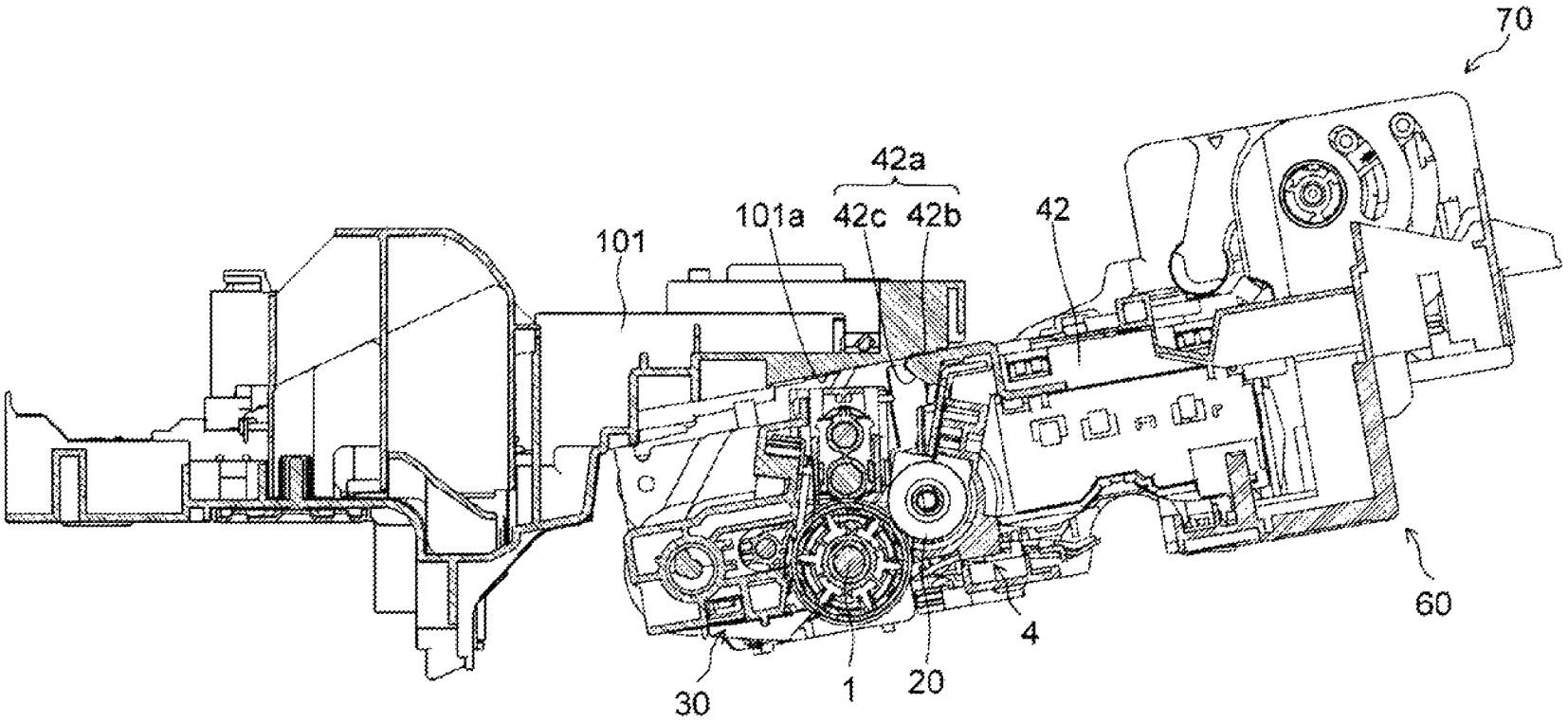
FIG. 7 is a sectional view of the image forming apparatus according to the embodiment of the present disclosure, with the imaging unit being pulled out the main apparatus body.
Figure 8:
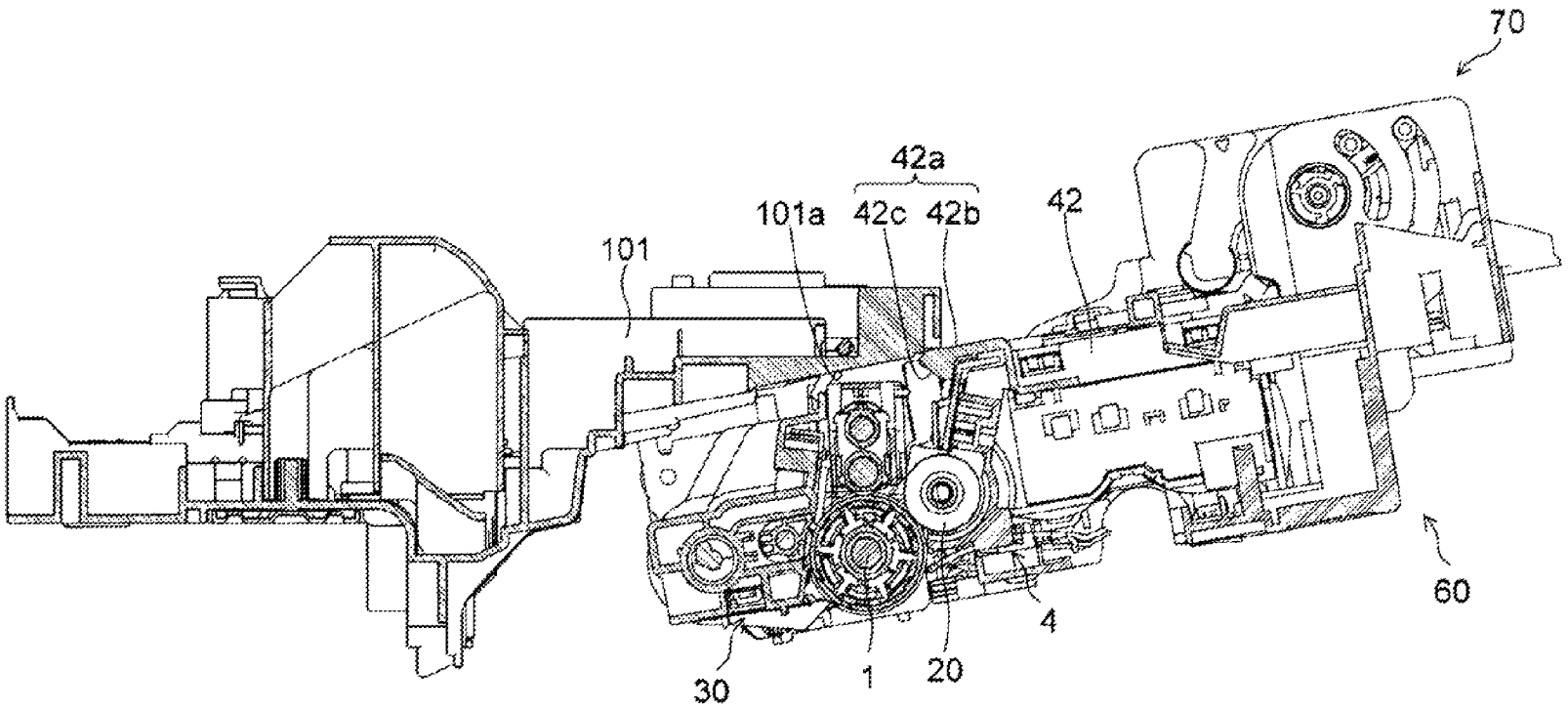
FIG. 8 is a sectional view of the image forming apparatus according to the embodiment of the present disclosure, with the imaging unit being pulled out the main apparatus body.

Then, as the imaging unit 70 is pulled toward the front and away from the main apparatus body as shown in FIGS. 7 and 8, the upper surface 42*b* of each rib 42*a* slides along the lower surface 101*a* of the upper portion of the casing 101 of the main apparatus body. In this way, the ribs 42*a* serve as guide members for guiding the imaging unit 70 being pulled out of the main apparatus body.

The ribs 42*a* also serve as guide member for guiding the imaging unit 70 being attached to the main apparatus body through abutment against the lower surface 101*a* of the upper portion 101*a* of the casing 101 of the main apparatus body.

Next, a description is given of the attachment and detachment operation of the developing device 4 to and from the drum unit 30 and the retaining frame 60. The retaining frame 60 detachably retains the drum unit 30 and the developing device 4.

Figure 2:
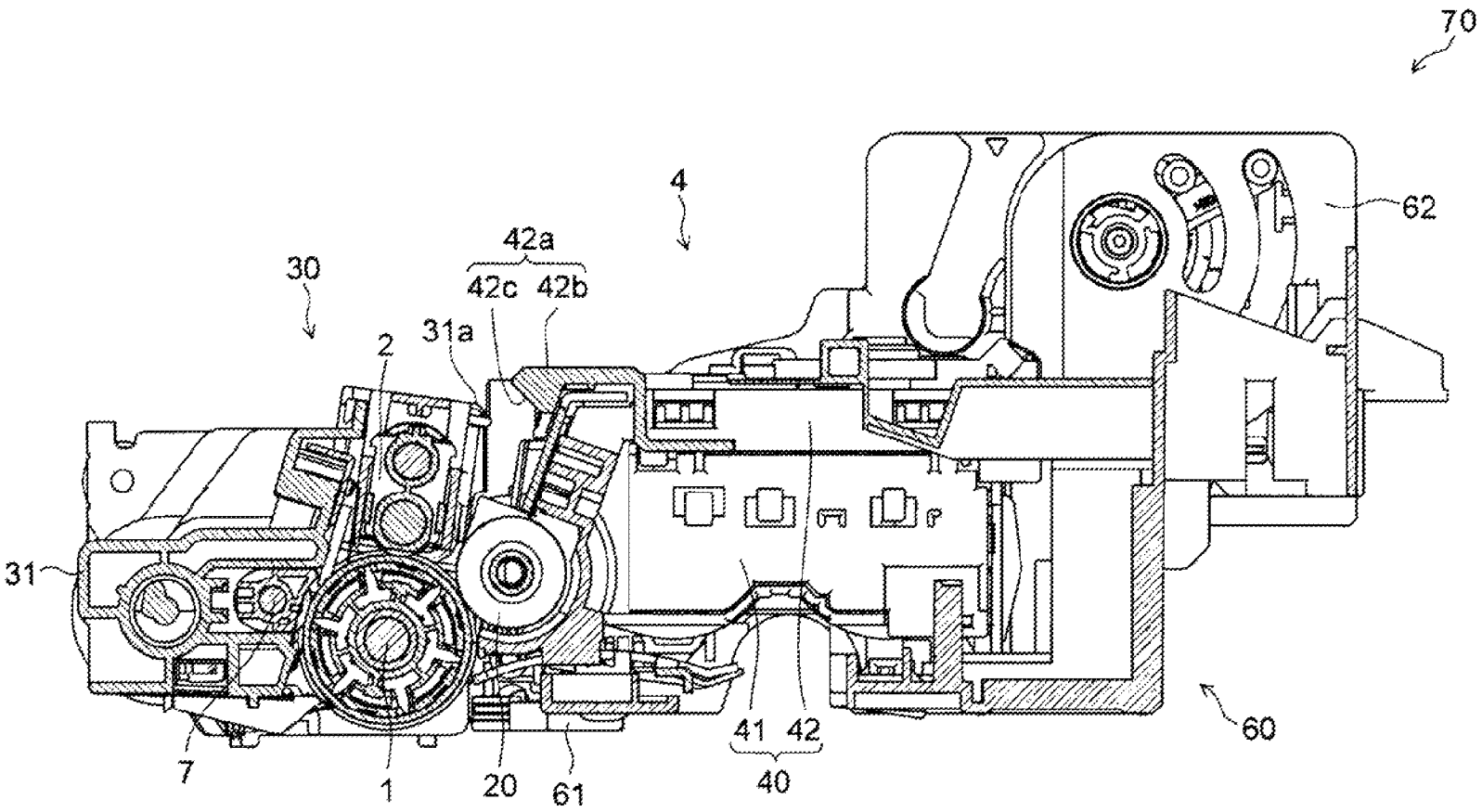
FIG. 2 is a transverse sectional view of an imaging unit of the image forming apparatus according to the embodiment of the present disclosure.
Figure 3:
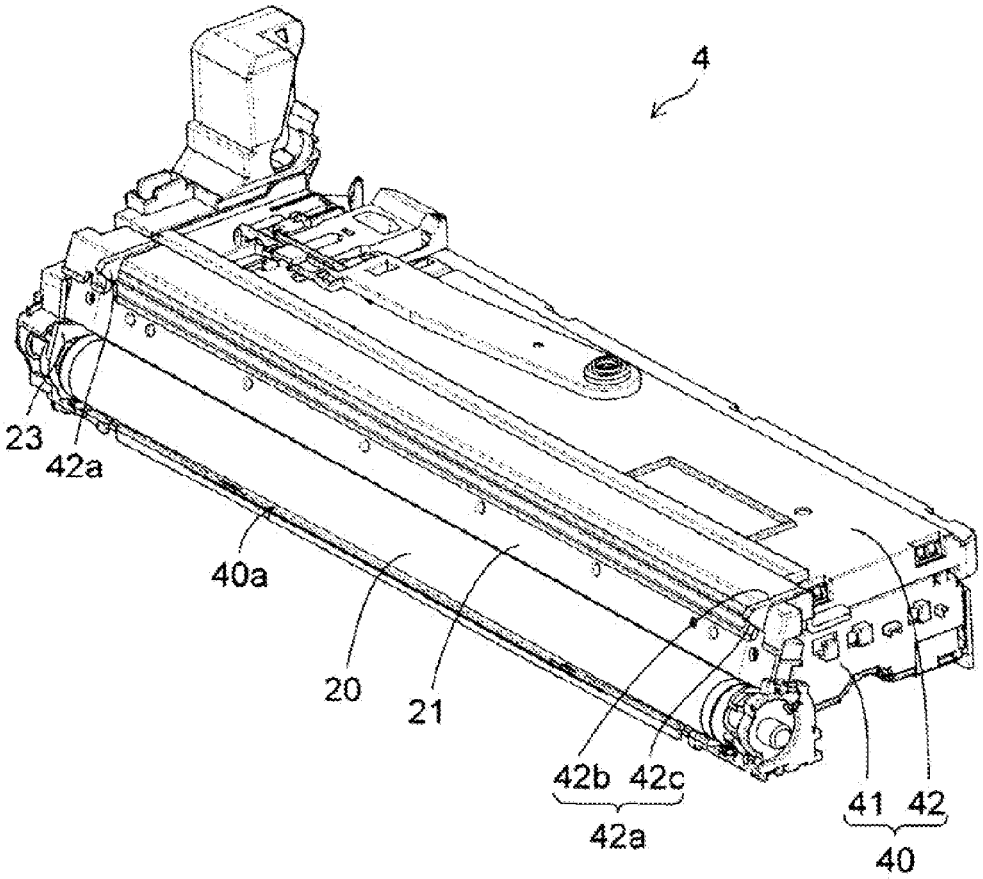
FIG. 3 is a perspective view of a developing device of the image forming apparatus according to the embodiment of the present disclosure.
Figure 9:
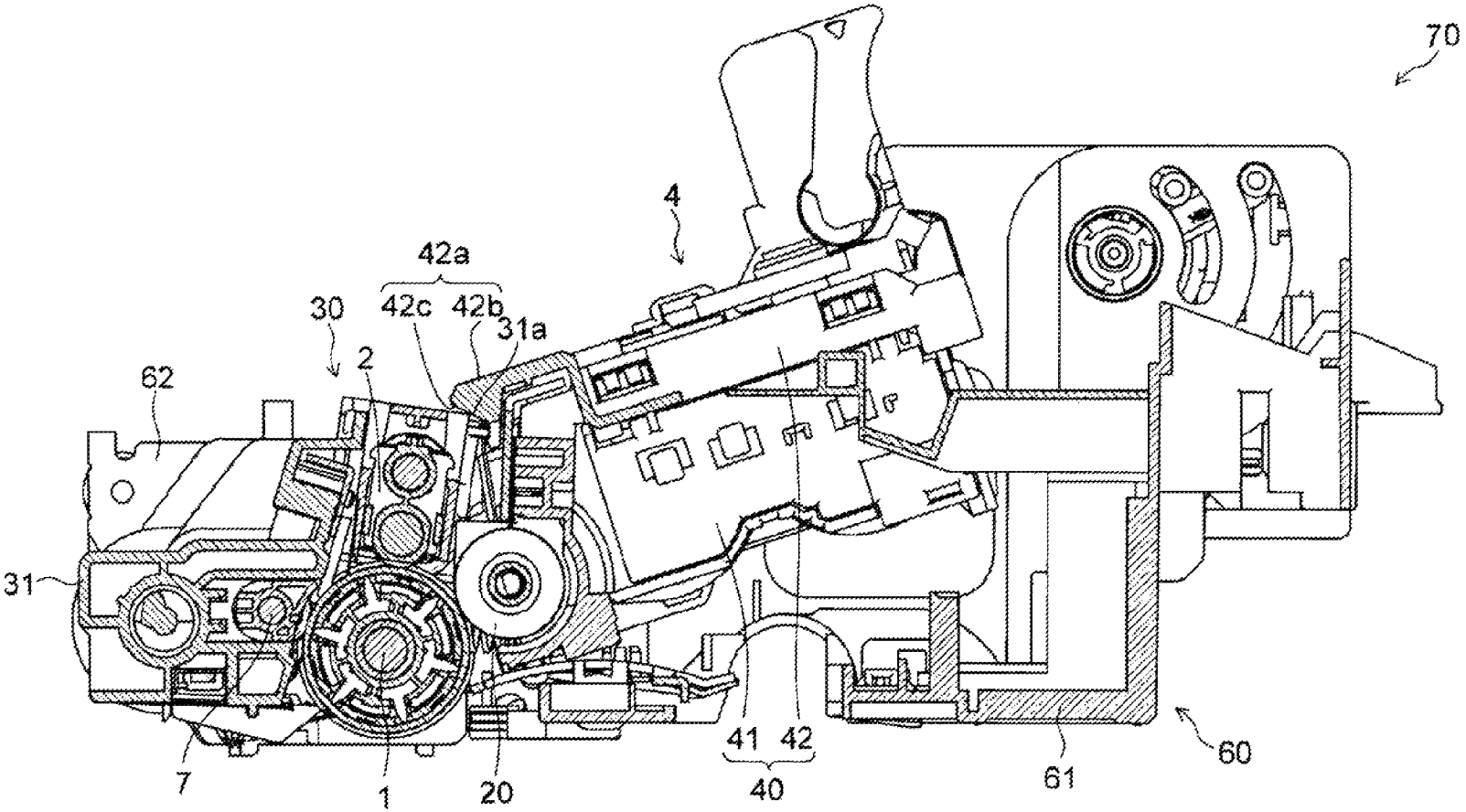
FIG. 9 is a sectional view of the image forming apparatus according to the embodiment of the present disclosure, with the developing device being detached from a drum unit and a retaining frame.

As shown in FIG. 2, to detach the developing device 4 from the drum unit 30 and the retaining frame 60, the toner container 5 (see FIG. 1) needs to be detached from the retaining frame 60 before the developing device 4. Then, as shown in FIG. 9, the front edge portion of the developing device 4, that is, the right edge portion of the developing device 4 shown in FIG. 9, is lifted up. In this state, the inclined surface 42*c* of each rib 42*a* of the cover part 42 abuts against the front edge portion of the upper surface 31*a* of the housing 31 of the drum unit 30.

Figure 10:
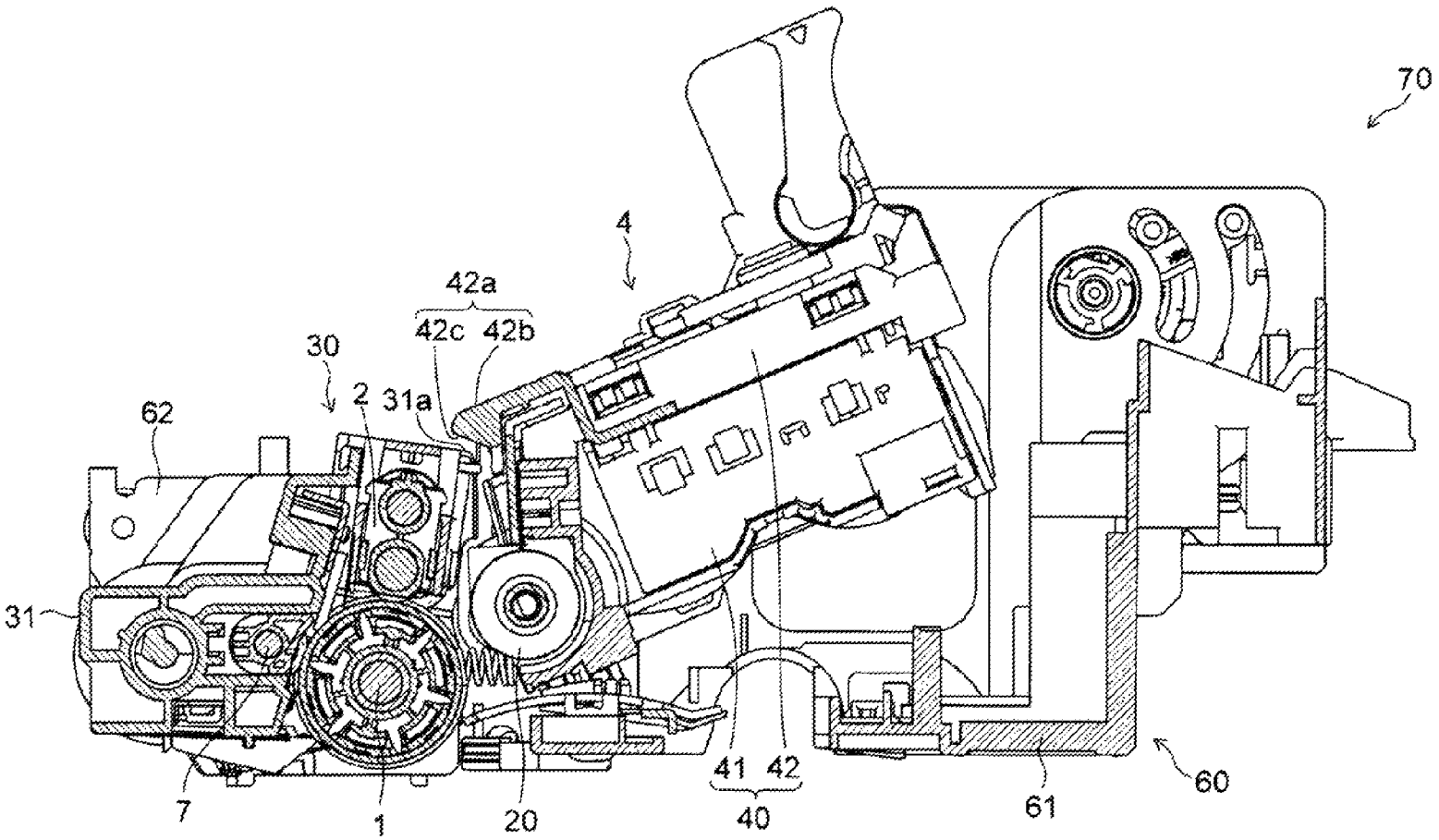
FIG. 10 is a sectional view of the image forming apparatus according to the embodiment of the present disclosure, with the developing device being detached from a drum unit and a retaining frame.

Then, as the developing device 4 is pulled upward toward the front, the developing device 4 comes to be detached from the drum unit 30 and the retaining frame 60 as shown in FIG. 10. As described above, the ribs 42*a* serve as guide member for guiding the developing device 4 being detached from the drum unit 30 and the retaining frame 60.

The ribs 42*a* also serve as guide member for guiding the developing device 4 being attached to the drum unit 30 and the retaining frame 60 through abutment against the front edge portion of the upper surface 31*a* of the housing 31 of the drum unit 30.

According to the present embodiment described above, the image forming apparatus 100 includes the drum unit 30, the developing device 4, and the main apparatus body. The drum unit 30 includes the photosensitive drum 1 on which an electrostatic latent image is formed. The cover part 42 is provided with the ribs 42*a* formed on the upper surface of the cover part 42 at positions corresponding to the axial ends of the developing roller 20. In other words, the ribs 42*a* are disposed at the widthwise edge portions of the cover part 42. The ribs 42*a* abut against the casing 101 of the main apparatus during attachment and during detachment of the imaging unit 70, which is an integral part formed of the drum unit 30, the developing device 4, the toner container 5, and the retaining frame 60, to the main apparatus body.

Through the above configuration, during attachment and during detachment of the imaging unit 70 to and from the main apparatus body, the ribs 42*a* of the cover part 42 are unfailingly brought into abutment against the main apparatus body. This improves the ease in attachment and detachment of the imaging unit 70 to and from the main apparatus body.

In addition, since the ribs 42*a* are located at the widthwise edge portions of the upper surface of the cover part 42, the cover part 42 is prevented from abutting against the main apparatus body at a widthwise central portion. This is effective to prevent the regulating blade 21 from centrally flexed to narrow the gap between the central portion of the regulating blade 21 and the developing roller 20. This leads to prevent aggregation of toner on the surface of the developing roller 20.

In addition, the ribs 42*a* abut against the housing 31 of the drum unit 30 during attachment and during detachment of the developing device 4 to and from the drum unit 30 and the retaining frame 60. Through the above configuration, the ribs 42*a* that serve to improve the ease in attachment and detachment of the imaging unit 70 to and from the main apparatus body can also serve to improve the ease in attachment and detachment of the developing device 4 and from the drum unit 30 and the retaining frame 60.

Additionally, each rib 42*a* has the upper surface 42*b* and the inclined surface 42*c* as described above. The upper surface 42*b* abuts against the casing 101 of the main apparatus body during attachment and during detachment of the imaging unit 70. The inclined surface 42*c* abuts against the housing 31 during attachment and during detachment of the developing device 4 to and from the drum unit 30 and the retaining frame 60. This configuration ensures that the ribs 42*a* are easily brought into abutment against the casing 101 of the main apparatus body while the imaging unit 70 is being attached to and detached from the main apparatus body. Also, while the developing device 4 is being attached to and detached from the drum unit 30 and the retaining frame 60, the ribs 42*a* are easily brought into abutment against the front edge portion of the upper surface 31*a* of the housing 31.

Additionally, the developing device 4 includes the bearings 22 and the blade retainers 23. The bearings 22 rotatably support the rotation shaft 20*a* of the developing roller 20 such that a predetermined gap is provided between each of the bearings 22 and the regulating blade 21 above the developing roller 20. The blade retainers 23 are each disposed on the outer circumferential surface of a corresponding one of the bearings 22 to retain a predetermined gap between the regulating blade 21 and the developing roller 20. With this configuration, the blade retainers 23 can prevent the gap between each end of the regulating blade 21 and the developing roller 20 from being narrower, despite a pressing force possibly applied by the ribs 42*a* to the ends of the regulating blade 21 when the ribs 42*a* are pressed by the main apparatus body during attachment and during detachment of the imaging unit 70 to and from the main apparatus body.

Additionally, the drum unit 30, the developing device 4, the toner container 5, and the retaining frame 60 are attachable to and detachable from the main apparatus body in an assembled state integrally as the imaging unit 70. Therefore, the drum unit 30, the developing device 4, and the toner container 5 can be collectively attached to and collectively detached from the main apparatus body. This improves the ease in attachment and detachment of the drum unit 30, the developing device 4, and the toner container 5 to and from the main apparatus body.

Note that the embodiment disclosed herein is only exemplary in all aspects and should not be construed as limiting. The scope of the present disclosure is defined by the appended claims and not by the description of the embodiment. The scope of the present disclosure encompasses any equivalents and alterations made without departing from the scope.

For example, the image forming apparatus 100 is not limited to a monochrome printer described above in the embodiment with reference to FIG. 1. The present disclosure is applicable to various image forming apparatuses each having an image bearing unit and a developing device that are integrally attachable to and integrally detachable from the main apparatus body. Examples of applicable image forming apparatuses include digital or analog monochrome copiers, color printers, color copiers, and facsimile machines.

Although the embodiment descried above is directed to an example in which the developer is a one-component developer consists of toner alone, the developer usable in the present disclosure is not limited to such. The developer used in the present disclosure may be a two-component developer containing both carrier and toner.

The embodiment described above is directed to an example in which the drum unit 30 and the developing device 4 are attachable to and detachable from the main apparatus body integrally with the toner container 5 and retaining frame 60. However, the present disclosure is not limited to such a configuration. The drum unit 30 and the developing device 4 may be attachable to and detachable from the main apparatus body separately from the toner container 5 and/or the retaining frame 60.

The embodiment described above is directed to an example in which the regulating blade 21 is restricted from centrally flexing to narrow the gap between the central portion of the regulating blade 21 and the developing roller 20. However, the present disclosure is not limited to such a configuration. A component other than the regulating blade 21 may be disposed to extend axially along the developing roller 20 at a position above the developing roller 20. In such a case, the present disclosure duly restricts the member from centrally flexing to narrow the gap between the central portion of the member and the developing roller 20.

What is claimed is:

1. An image forming apparatus comprising:

an image bearing unit that includes an image bearing member on which an electrostatic latent image is formed;

a developing device that includes a developing roller that is disposed opposite to the image bearing member and supplies toner to the image bearing member, and a first housing that stores therein developer containing the toner and rotatably supports the developing roller;

a main apparatus body to which the image bearing unit and the developing device are detachably attached; and a second housing, wherein the image bearing unit and the developing device are integrally attachable to and integrally detachable from the main apparatus body, the first housing includes a pair of ribs on an upper surface thereof at positions corresponding to opposite axial ends of the developing roller, the ribs abutting against a casing part of the main apparatus body while the image bearing unit and the developing device are being integrally attached to and integrally detached from the main apparatus body, and the ribs abut against the second housing while the developing device is being detached from the image bearing unit.

2. The image forming apparatus according to claim 1, wherein each of the ribs has an upper surface that abuts against the casing of the main apparatus body while the image bearing unit and the developing device are being integrally attached to and integrally detached from the main apparatus body, and an inclined surface that extends downward from the upper surface at an acute angle relative to the upper surface, the inclined surface abutting against the second housing while the developing device is being detached from the image bearing unit.

3. The image forming apparatus according to claim 1, wherein the developing device includes a regulating blade disposed opposite to the developing roller with a predetermined gap above the developing roller, a pair of bearings that rotatably support a rotation shaft of the developing roller, and a pair of blade retaining members provided on the pair of bearings, each of the blade retaining member being disposed on an outer circumferential surface of a corresponding one of the bearings so as to retain the predetermined gap between the regulating blade and the developing roller, and the ribs are disposed above opposite ends of the regulating blade.

4. The image forming apparatus according to claim 1, further comprising:

a retaining frame that is attachable to and detachable from the main apparatus body and detachably retains the image bearing unit and the developing device; and a developer supplying unit that is attachable to and detachable from the retaining frame, wherein the image bearing unit, the developing device, the developer supplying unit, and the retaining frame are integrally attachable to and integrally detachable from the main apparatus body.

* * * * *